US007710833B2

(12) United States Patent
Shimizu

(10) Patent No.: US 7,710,833 B2
(45) Date of Patent: May 4, 2010

(54) RADIO-CONTROLLED TIMEPIECE AND METHOD OF CHANGING THE WAVEFORM DISCRIMINATION STANDARD

(75) Inventor: Eisaku Shimizu, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/882,735

(22) Filed: Aug. 3, 2007

(65) Prior Publication Data

US 2008/0049558 A1 Feb. 28, 2008

(30) Foreign Application Priority Data

Aug. 25, 2006 (JP) ..... 2006-229538

(51) Int. Cl.
*G04C 11/02* (2006.01)

(52) U.S. Cl. ..... 368/47

(58) Field of Classification Search ..... 368/10, 368/46, 47, 52; 455/39, 502, 503; 340/825.2, 340/825.21
See application file for complete search history.

(56) References Cited

U.S. PATENT DOCUMENTS 5,739,762 A * 4/1998 Kuramatsu et al. ..... 340/825.21
6,166,651 A * 12/2000 Kushita ..... 340/7.1
2003/0117901 A1 6/2003 Takada et al.
2005/0094495 A1 * 5/2005 Takada et al. ..... 368/47
2005/0175039 A1 8/2005 Haefner et al.
2005/0195690 A1 * 9/2005 Kondo ..... 368/47
2006/0067166 A1 * 3/2006 Murata et al. ..... 368/47
2006/0140282 A1 * 6/2006 Kondo ..... 375/242

FOREIGN PATENT DOCUMENTS

EP 1 662 344 A2 5/2006
JP 2003-222687 A 8/2003

* cited by examiner

*Primary Examiner*—Vit W Miska
(74) *Attorney, Agent, or Firm*—Global IP Counselors, LLP

(57) ABSTRACT

A radio-controlled timepiece has a reception means that receives a standard radio signal containing time information; a demodulation means that demodulates the standard radio signal received by the reception means and outputs a demodulated signal; a waveform discrimination means that discriminates the waveform of the demodulated signal based on a specific waveform discrimination standard, and outputs a code corresponding to the waveform; a time information conversion means that converts the code output by the waveform discrimination means to time information; and a waveform discrimination standard changing means for changing the waveform discrimination standard.

6 Claims, 7 Drawing Sheets

| | PERIOD A | PERIOD B | ERROR CODE | M CODE |
|---|---|---|---|---|
| WAVEFORM DISCRIMINATION STANDARD I | 1 ~ 8 | 9 ~ 16 | 0 | 1 ~ 62 |
| WAVEFORM DISCRIMINATION STANDARD II | 1 ~ 9 | 10 ~ 17 | 0 | 1 ~ 62 |
| WAVEFORM DISCRIMINATION STANDARD III | 1 ~ 10 | 11 ~ 18 | 0 | 1 ~ 62 |

FIG. 2

RADIO-CONTROLLED TIMEPIECE AND METHOD OF CHANGING THE WAVEFORM DISCRIMINATION STANDARD

BACKGROUND

1. Field of Invention

The present invention relates to a radio-controlled timepiece and its method of changing the waveform discrimination standard.

2. Description of Related Art

Germany, Britain, the United States, Japan, and other countries transmit long-wave standard time signals carrying time information on a carrier wave frequency of several 10 kHz, and radio-controlled timepieces that receive and use this standard time signal to adjust the time have become common. The long-wave standard time signal is a pulse wave that denotes a time code of pulse values such as 1, 0, and M each second, and transmits one full frame in 1 minute. Each frame contains time information including the year, hour, and minute.

The radio-controlled timepiece therefore detects the pulse waveforms denoting each code from the long-wave standard time signal, and determines the value, such as 1, 0, or M, represented by each pulse (referred to below as a waveform discrimination process).

The frequency of the carrier wave and the waveforms of the pulses denoting the code values 1, 0, or M in these long-wave standard time signals differ depending on the country.

The process whereby a radio-controlled timepiece sets the time using a long-wave standard time signal is described briefly below.

The standard time signal is received by an antenna such as a tuning bar antenna and passed to a demodulation circuit.

The demodulation circuit includes an AGC (automatic gain control) amplifier, a narrow-band bandpass filter using a crystal oscillator, a rectification circuit, and a decoder circuit.

The demodulation circuit boosts the antenna output to a required level by the AGC amplifier, extracts the required signal band using the narrow-band bandpass filter, and detects the signal by amplitude-modulated wave detection using the rectification circuit. The detector output is then compared with a reference level by a decoder, and the level is converted to output the time code signal.

The radio-controlled timepiece applies the waveform discrimination process to the time code signal and identifies the code. The time is then adjusted based on the result of the waveform discrimination process.

Each pulse in the time code of the standard time signal transmitted in Japan, for example, starts at the rising edge, that is, where the time code signal changes from LOW to HIGH. The waveform discrimination process taught in Japanese Unexamined Patent Appl. Pub. JP-A-2003-222687, for example, therefore uses a 32-Hz sampling circuit to sample the time code signal for 1 second from a detected rising edge and acquires 32 samples (samples 0 to 31).

The 32 samples are then divided into plural discrimination periods in which the HIGH and LOW signal levels differ according to the code. The Japanese JJY standard time signal, for example, is divided into period A (samples 1 to 5), period B (samples 8 to 13), period C (samples 18 to 23), and period D (samples 27 to 31).

The HIGH/LOW signal level of each code changes in the samples not belonging to any of the discrimination periods. For example, the 0 code changes from LOW to HIGH between period D and period A, and changes from HIGH to LOW between period C and period D.

Based on the number of HIGH and LOW samples in each period, the HIGH or LOW value of each period is determined.

For example, whether period A denotes a HIGH or LOW signal level is determined according to the number of HIGH and LOW signal levels in samples 1 to 5.

Each code is then identified from the HIGH or LOW signal level of each discrimination period.

If period A is HIGH, period B is HIGH, and period C is LOW, a code value of "1" is identified, for example.

Note that period D must always be LOW, and an error is therefore returned if period D is HIGH.

However, deviations can occur in the reference level of the decoder circuit and variations can occur in the capacitance connected to the AGC amplifier during the radio-controlled timepiece manufacturing process.

When such variations are introduced during radio-controlled timepiece production, the radio-controlled timepiece can output different time code signals even through the same long-wave standard time signal is received in a reception environment that is unaffected by the field strength or signal/noise ratio (S/N) of the long-wave standard time signal. More specifically, the signal width of the pulse waves in each code may vary.

When the effects of the field strength and S/N ratio of the long-wave standard time signal are considered, the signal width of the pulse waves in each code can vary even more.

SUMMARY

A problem with the method taught in Japanese Unexamined Patent Appl. Pub. JP-A-2003-222687 is that because the plural discrimination period are set according to the pulse waveforms in each code, the waveform discrimination process returns inaccurate results if the signal width of the pulses in each code changes due to the effects of the field strength and S/N ratio of the standard time signal or manufacturing deviations in the radio-controlled timepiece.

Furthermore, if the waveform discrimination process does not execute accurately, an error code will be output, the long-wave standard time signal must be received again, and reception time increases.

For example, if the pulse signal width of the 0 code (how long the signal level remained HIGH) changes and becomes shorter, period C may be determined to be LOW instead of HIGH. The waveform discrimination process will therefore erroneously output a code other than the correct code of 0.

The radio-controlled timepiece and the method of changing the waveform discrimination standard used by the radio-controlled timepiece according to the present invention can accurately execute the waveform discrimination process even when affected by manufacturing variations, can thereby shorten the reception time, and reduce power consumption.

A radio-controlled timepiece according to a first aspect of the invention has a reception means that receives a standard radio signal containing time information; a demodulation means that demodulates the standard radio signal received by the reception means and outputs a demodulated signal; a waveform discrimination means that discriminates the waveform of the demodulated signal based on a specific waveform discrimination standard, and outputs a code corresponding to the waveform; a time information conversion means that converts the code output by the waveform discrimination means to time information; and a waveform discrimination standard changing means for changing the waveform discrimination standard.

The radio-controlled timepiece according to this aspect of the invention has a waveform discrimination standard changing means and can therefore change the waveform discrimination standard. More specifically, the waveform discrimination process can execute accurately even if the radio-controlled timepiece is affected by manufacturing variations or the field strength or S/N ratio of the long-wave standard time signal because the waveform discrimination means discriminates the waveform of the demodulated signal based on the waveform discrimination standard selected by the waveform discrimination standard changing means and can therefore output the correct code corresponding to the waveform.

Furthermore, because the waveform discrimination process operates accurately, error codes are returned less frequently, the reception time is shortened, and power consumption is reduced.

In the German standard time signal (DCF77), for example, the waveform of a pulse denoting a 0 has a LOW signal width of 100 ms, and the waveform of a 1 pulse has a LOW signal width of 200 ms. In the Japanese standard time signal (JJY), however, the waveform of a pulse denoting a 0 has a LOW signal width of 800 ms, and the waveform of a 1 pulse has a LOW signal width of 500 ms.

The difference in the signal widths of the pulses waves of the codes carried in the German standard time signal is less than in the standard time signals transmitted in other countries. As a result, when the signal widths of the pulse waves of the transmitted codes vary due to the effects of deviations in the manufacture of a radio-controlled timepiece or the field strength and S/N ratio of the standard time signal, the waveform discrimination process produces errors more frequently when decoding the German standard time signal than when decoding other standard time signals.

However, by demodulating a reference signal that repeats a specific code in the long-wave standard time signal or demodulating the standard time signal itself and measuring the signal widths in the demodulated signals to determine the deviation from the original signal width when manufacturing the radio-controlled timepiece, the waveform discrimination standard changing means can change the waveform discrimination standard based on this deviation so that the waveform discrimination process can execute accurately, the reception time can therefore be shortened, and power consumption can be reduced.

For example, the reception means can be caused to receive a reference signal that repeats the 0 pulse wave (a pulse that stays LOW for 100 ms), and if the demodulated reference signal output from the demodulation means has a signal width of 109 ms, the waveform discrimination standard of the waveform discrimination means can be changed to the different signal width of 109 ms during radio-controlled timepiece production.

Preferably, the waveform discrimination standard divides the standard radio signal into a plurality of discrimination periods each including the timing where the signal level of the waveform changes in the code denoting a binary 0, the code denoting a binary 1, and the code denoting a marker; the waveform discrimination means discriminates each code based on whether the signal level of the waveform of the demodulated signal changes in each of the discrimination periods; and the waveform discrimination standard changing means changes the waveform discrimination standard by changing at least one of the width and the starting position of each discrimination period.

The discrimination periods are set to plural positions referenced to the starting position of the pulse waveform for each code so that when the signal is sampled by a sampling circuit at a 64-Hz sampling frequency, for example, each discrimination period spans the timing where the signal level of the waveform for a particular code value changes.

The German standard time signal (DCF77) and the Japanese standard time signal both transmit one code per second and one frame per minute. The falling edge of each code pulse, that is, where the time code signal goes from HIGH to LOW, is the starting position of each code pulse. The pulse for code 0 therefore goes LOW at this reference position and then goes HIGH 100 ms later. The pulse for code 1 likewise goes LOW at this reference position and then goes HIGH 200 ms later.

Discrimination periods for the German standard time signal (DCF77) are therefore set to a period including the point 100 ms after the reference position, and a period including the point 200 ms after the reference position.

The discrimination periods are defined by the width and the starting position of the period.

For example, if the width of the period including the time 100 ms after the reference position at 0 ms is 100 ms and the starting position of the period is 20 ms after the reference position, discrimination period I is set to greater than or equal to 20 ms and less than 120 ms from the reference position at 0 ms.

The waveform discrimination standard can be changed in this example by setting a discrimination period II that changes the width of discrimination period I. If the width is changed to 110 ms, for example, discrimination period II is the period greater than or equal to 20 ms and less than 130 ms from the reference position at 0 ms.

Likewise, if the width of the period including the time 200 ms after the reference position at 0 ms is 100 ms and the starting position of the period is 120 ms after the reference position, discrimination period I is set to greater than or equal to 120 ms and less than 220 ms from the reference position at 0 ms.

The waveform discrimination standard can be changed in this example by setting a discrimination period II that changes the starting position of discrimination period I. If the starting position is changed to 130 ms, for example, discrimination period II is the period greater than or equal to 130 ms and less than 230 ms from the reference position at 0 ms.

This aspect of the invention thus sets a plurality of discrimination periods each including the timing at which the signal level of a code pulse changes, and the waveform discrimination means can discriminate the codes based on whether or not the signal level of the waveform changed in the demodulated reference signal or the demodulated signal.

Furthermore, because the waveform discrimination standard changing means changes the waveform discrimination standard by changing the width or the starting position, or both the width and the starting position, of each discrimination period, the waveform discrimination standard can be easily changed by providing a plurality of waveform discrimination standards in which the widths and the starting positions of the discrimination periods differ, and selecting the appropriate waveform discrimination standard.

Further preferably, the waveform discrimination standard changing means has a waveform discrimination standard storage means for storing a plurality of waveform discrimination standards, and a selection means for selecting one waveform discrimination standard from among the plurality of waveform discrimination standards stored in the waveform discrimination standard storage means; and the waveform discrimination means discriminates the demodulated signal waveforms based on the waveform discrimination standard selected by the selection means.

In this aspect of the invention the waveform discrimination standard storage means can store a plurality of waveform discrimination standards in which the widths and the starting positions of the discrimination periods differ, and the selection means can select the appropriate waveform discrimination standard from among the plural stored waveform discrimination standards.

The waveform discrimination standard can conceivably be changed by computing the waveform discrimination standard based on the changed signal width. For example, if the measured signal width is 109 ms as described above, and the discrimination period width is 100 ms, the starting position of the discrimination period can be set to the measured signal width minus 50 ms, or 109 ms−50 ms=59 ms. This method requires solving an equation every time the waveform discrimination standard is changed, however.

If the waveform discrimination standard changing means has a selection means, however, the reception means can be caused to receive a reference signal that repeats the 0 pulse wave (a pulse that stays LOW for 100 ms), and if the demodulated reference signal output from the demodulation means has a signal width of 109 ms, the selection means can simply select the waveform discrimination standard appropriate to the measured signal width of 109 ms from among the plural stored waveform discrimination standards to change the waveform discrimination standard of the waveform discrimination means during radio-controlled timepiece production more quickly than if an equation must be calculated.

Further preferably, the waveform discrimination standard changing means has a signal width measurement means that measures the signal width of the demodulated signal waveforms, and changes the waveform discrimination standard based on the measurements returned by the signal width measurement means.

The signal width measurement means in this aspect of the invention measures the actual signal width of the waveforms in the demodulated reference signal or demodulated signal, and the waveform discrimination standard can therefore be changed automatically according to the resulting measurements. This aspect of the invention enables automatically changing the waveform discrimination standard as a result of the reception means receiving the long-wave standard time signal when the radio-controlled timepiece is used, and changing the waveform discrimination standard is thus not limited to when the radio-controlled timepiece is manufactured. As a result, the waveform discrimination process can run accurately even if the signal width of the code pulses varies due to the effects of the field strength and S/N ratio of the standard time signal, temperature fluctuations, or aging.

Another aspect of the invention is a method of changing a waveform discrimination standard for a radio-controlled timepiece that has a reception means that receives a standard radio signal containing time information; a demodulation means that demodulates the standard radio signal received by the reception means and outputs a demodulated signal; a waveform discrimination means that discriminates the waveform of the demodulated signal based on a specific waveform discrimination standard, and outputs a code corresponding to the waveform; a time information conversion means that converts the code output by the waveform discrimination means to time information; and a waveform discrimination standard changing means for changing the waveform discrimination standard. The method of changing the waveform discrimination standard includes a reference signal output step of outputting a reference signal that repeats a specific code in the standard radio signal; a reference signal reception step of receiving the reference signal; a reference signal demodulation step of demodulating the reference signal and outputting a demodulated reference signal; a signal width measurement step of measuring the signal width of waveforms in the demodulated reference signal and acquiring the resulting measurements; and a waveform discrimination standard changing step of changing the waveform discrimination standard according to the resulting measurements.

This aspect of the invention affords the same effects and benefits as the radio-controlled timepiece described above.

In addition, a reference signal repeating a specific code pulse is output in the reference signal output step, the reference signal is received in the reference signal reception step, and the reference signal demodulation step demodulates the reference signal and outputs a demodulated reference signal. As a result, the waveform discrimination standard can be changed in the factory using a precise reference signal with sufficient signal strength and no noise. Change in the signal width caused by variations during the manufacture of the radio-controlled timepiece can therefore be accurately detected, and the waveform discrimination standard can be reliably set to account for detected deviations introduced in the manufacturing process.

Another aspect of the invention is a method of changing a waveform discrimination standard for a radio-controlled timepiece, the radio-controlled timepiece having a reception means that receives a standard radio signal containing time information; a demodulation means that demodulates the standard radio signal received by the reception means and outputs a demodulated signal; a waveform discrimination means that discriminates the waveform of the demodulated signal based on a specific waveform discrimination standard, and outputs a code corresponding to the waveform; a time information conversion means that converts the code output by the waveform discrimination means to time information; and a waveform discrimination standard changing means for changing the waveform discrimination standard. The method of changing the waveform discrimination standard includes a standard radio signal reception step of receiving the standard radio signal; a standard radio signal demodulation step of demodulating the standard radio signal and outputting a demodulated signal; a signal width measurement step of measuring the signal width of waveforms in the demodulated reference signal and acquiring the resulting measurements; and a waveform discrimination standard changing step of changing the waveform discrimination standard according to the resulting measurements.

This aspect of the invention affords the same effects and benefits as the radio-controlled timepiece described above.

The standard radio signal reception step thus receives a standard radio signal, and the standard radio signal demodulation step demodulates the standard radio signal and outputs a demodulated signal. The waveform discrimination standard changing step then changes the waveform discrimination standard according to the signal width of the waveforms in the demodulated signal. The waveform discrimination standard can therefore be changed automatically when the radio-controlled timepiece is used instead of when the radio-controlled timepiece is manufactured. This aspect of the invention enables automatically changing the waveform discrimination standard when the radio-controlled timepiece is used, and changing the waveform discrimination standard is thus not limited to when the radio-controlled timepiece is manufactured. As a result, the waveform discrimination process can run accurately even if the signal width of the code pulses varies due to factors other than manufacturing variations, including the effects of the field strength and S/N ratio of the standard time signal, temperature fluctuations, or aging.

Further preferably, the signal width measurement step measures the signal width of the waveforms by sampling the demodulated reference signal or the demodulated signal to acquire the measurements; and the waveform discrimination standard changing step changes the waveform discrimination standard based on the most numerous value in the resulting measurements when a plurality of measurements are acquired.

This aspect of the invention enables changing the waveform discrimination standard based on the measured signal width when only one measurement is taken. Furthermore, the effect of measurement errors can be suppressed by taking multiple measurements, and the waveform discrimination standard can be changed based on highly precise measurements.

For example, if five LOW signal widths are measured in the sampled demodulated reference signal or demodulated signal and the results are 109 ms, 125 ms, 109 ms, 93 ms, and 109 ms, the 109 ms result is most frequent with a count of 3, and the waveform discrimination standard can be changed based on the measured signal width of 109 ms.

The radio-controlled timepiece and the method of changing the waveform discrimination standard used by the radio-controlled timepiece according to the present invention can accurately execute the waveform discrimination process even when affected by manufacturing variations, thereby shortening the reception time and reducing power consumption.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 2 shows examples of waveform discrimination standards.

DESCRIPTION OF THE PREFERRED EMBODIMENTS

Preferred embodiments of the present invention are described below with reference to the accompanying figures.

Embodiment 1

A radio-controlled timepiece according to a first embodiment of the invention is described below.

Figure 1:
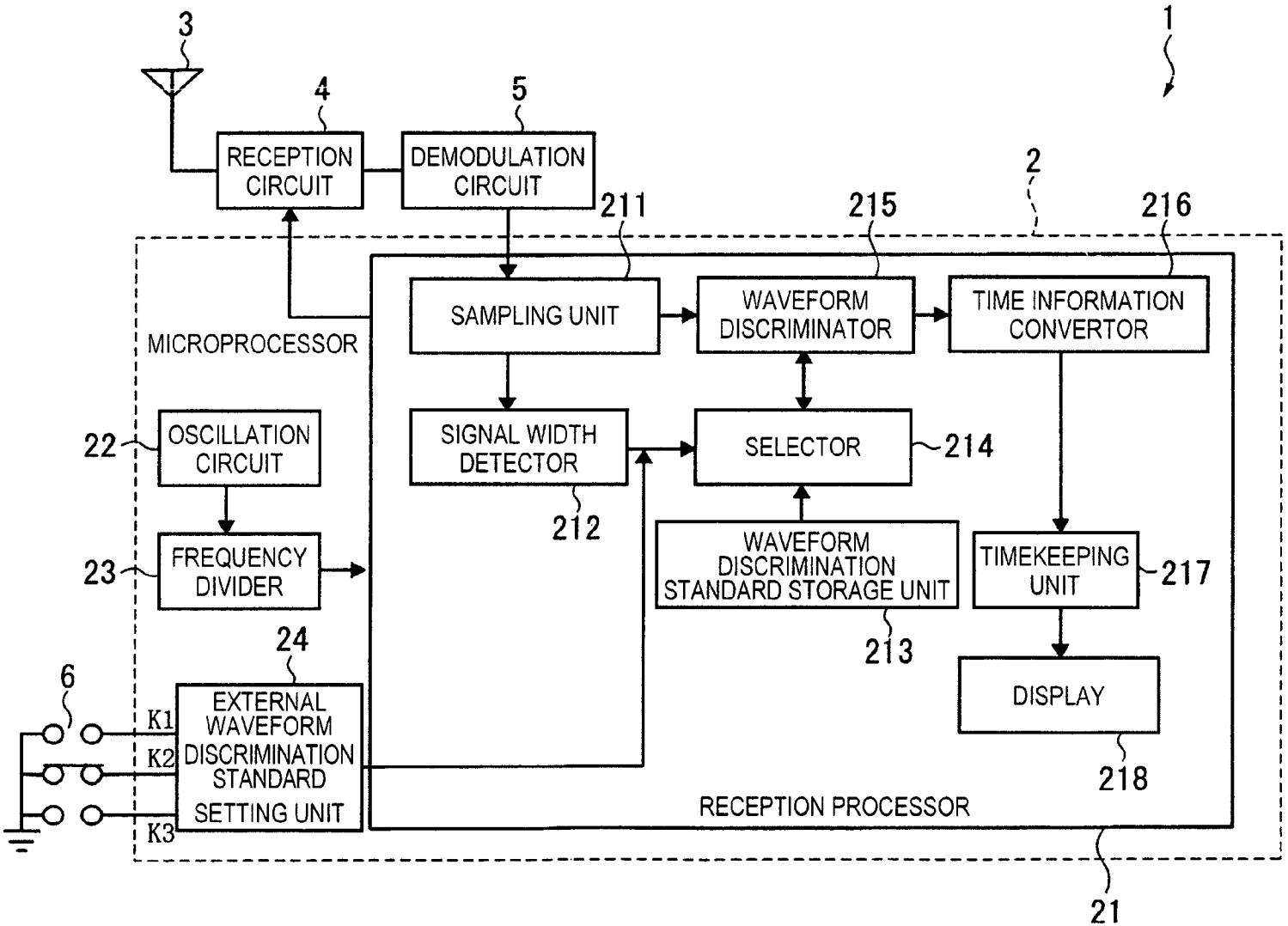
FIG. 1 is a block diagram of a radio-controlled timepiece according to a preferred embodiment of the invention.

As shown in FIG. 1 this radio-controlled timepiece 1 has a microprocessor 2, an antenna 3, a reception circuit (reception means) 4, a demodulation circuit (demodulation means) 5, and a jumper switch 6. The reception circuit 4 receives long-wave standard time signals through the antenna 3 according to control signals output from the microprocessor 2. The demodulation circuit 5 demodulates the long-wave standard time signal received by the reception circuit 4 to get the time code signal.

The microprocessor 2 has a reception processor 21, an oscillation circuit 22 for outputting a reference clock, a frequency divider 23, and a external waveform discrimination standard setting unit 24. The reception processor 21 outputs a control signal to the reception circuit 4 and receives the time code signal demodulated by the demodulation circuit 5. The frequency divider 23 frequency divides the reference clock output from the oscillation circuit 22 and supplies the clock signal to the reception processor 21. The external waveform discrimination standard setting unit 24 enables externally setting the waveform discrimination standard.

The reception processor 21 has a sampling unit 211, a signal width detector 212, a waveform discrimination standard storage unit 213, a selector 214, a waveform discriminator 215, a time information convertor 216, a timekeeping unit 217, and a display 218.

The sampling unit 211 samples the time code signal demodulated by the demodulation circuit 5. This embodiment of the invention uses a 64-Hz sampling circuit for sampling.

The signal width detector 212 measures the signal width between the falling edge and the rising edge of the time code signal sampled by the sampling unit 211, and thus measures the LOW signal width. This embodiment of the invention measures the LOW signal width in order to discriminate the codes in the German standard time signal DCF77. Note that the M code has a LOW signal width of 0 ms.

The waveform discrimination standard storage unit 213 stores the waveform discrimination standards for discriminating the waveform of the time code signal.

In this aspect of the invention the waveform discrimination standard storage unit 213 therefore stores waveform discrimination standards I to III each defining plural discrimination periods. The width or the starting position, or both the width and the starting position, is different in each of the discrimination periods. Each discrimination period includes the timing at which the signal level of the waveform of the pulse denoting a particular code value changes in the German standard time signal.

In the German standard time signal a 0 pulse has a LOW signal width of 100 ms, a 1 pulse has a LOW signal width of 200 ms, and two discrimination periods A and B are provided. Period A is the period containing the rising edge of the 0 pulse, and period B is the period containing the rising edge of the 1 pulse.

Figure 3:
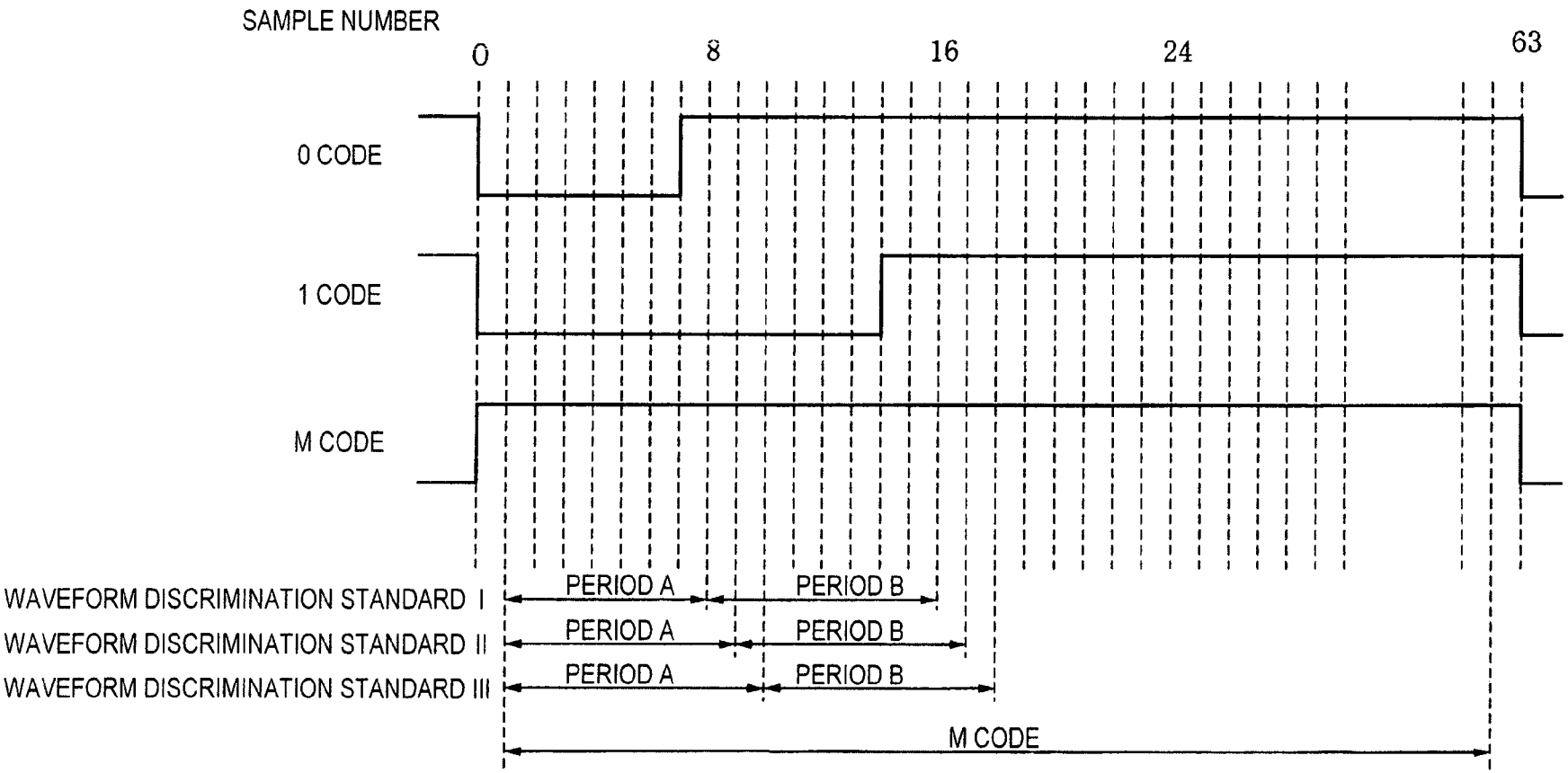
FIG. 3 is a timing chart showing the relationship between plural discrimination periods and the codes in the German standard time signal.

The relationship between the discrimination periods in waveform discrimination standards I to III and the codes of the German standard time signal is described next with reference to FIG. 3.

As described above the German standard time signal transmits one code per second, and transmits one frame per minute. Each code pulse starts from the falling edge, that is, from the point where the time code signal goes from HIGH to LOW.

Therefore, when the sampling unit 211 samples the time code signal referenced to the starting position of the pulse wave of the code transmitted each second (sample 0), samples 0 to 7 are LOW in the pulse waveform of the 0 code because the pulse remains LOW for 100 ms, and samples 0 to 14 are LOW in the pulse waveform of the 1 code because the pulse remains LOW for 200 ms.

The sampling unit 211 operates at a 64-Hz sampling frequency, and the sampling interval of the time code signal is therefore approximately 15.6 ms.

Note that samples 0 to 63 are all HIGH for the M code.

The discrimination periods are set to periods including the position where the time code signal goes from LOW to HIGH. Period A in waveform discrimination standard I is therefore set to samples 1 to 8 because the timing at which the 0 pulse signal level changes is sample 7, and period B in waveform discrimination standard I is set to samples 9 to 16 because the timing at which the signal level of the 1 pulse changes is sample 14.

Period A in waveform discrimination standard II is samples 1 to 9, and thus changes the width of period A in waveform discrimination standard I. Period B in waveform discrimination standard II is samples 10 to 17, and thus changes the width of period A in waveform discrimination standard I.

The discrimination period for detecting the M code is samples 1 to 62 in waveform discrimination standards I to III.

The error code is output by the waveform discriminator 215 when a 0, 1, or M is not detected, and a discrimination period is therefore not set for error code detection.

The selector 214 selects one of the waveform discrimination standards from among the waveform discrimination standards I to III stored in the waveform discrimination standard storage unit 213.

The waveform discriminator 215 discriminates the waveform of the time code signal sampled by the sampling unit 211 based on the waveform discrimination standard selected by the selector 214, and outputs the corresponding codes.

The time information convertor 216 converts the code output from the waveform discriminator 215 to time information.

The timekeeping unit 217 keeps time based on the reference clock generated by the oscillation circuit 22, and adjusts the time based on the information output by the time information convertor 216.

The display 218 then displays the time kept by the timekeeping unit 217.

The method of changing the waveform discrimination standard of the radio-controlled timepiece 1 is described next.

Figure 4:
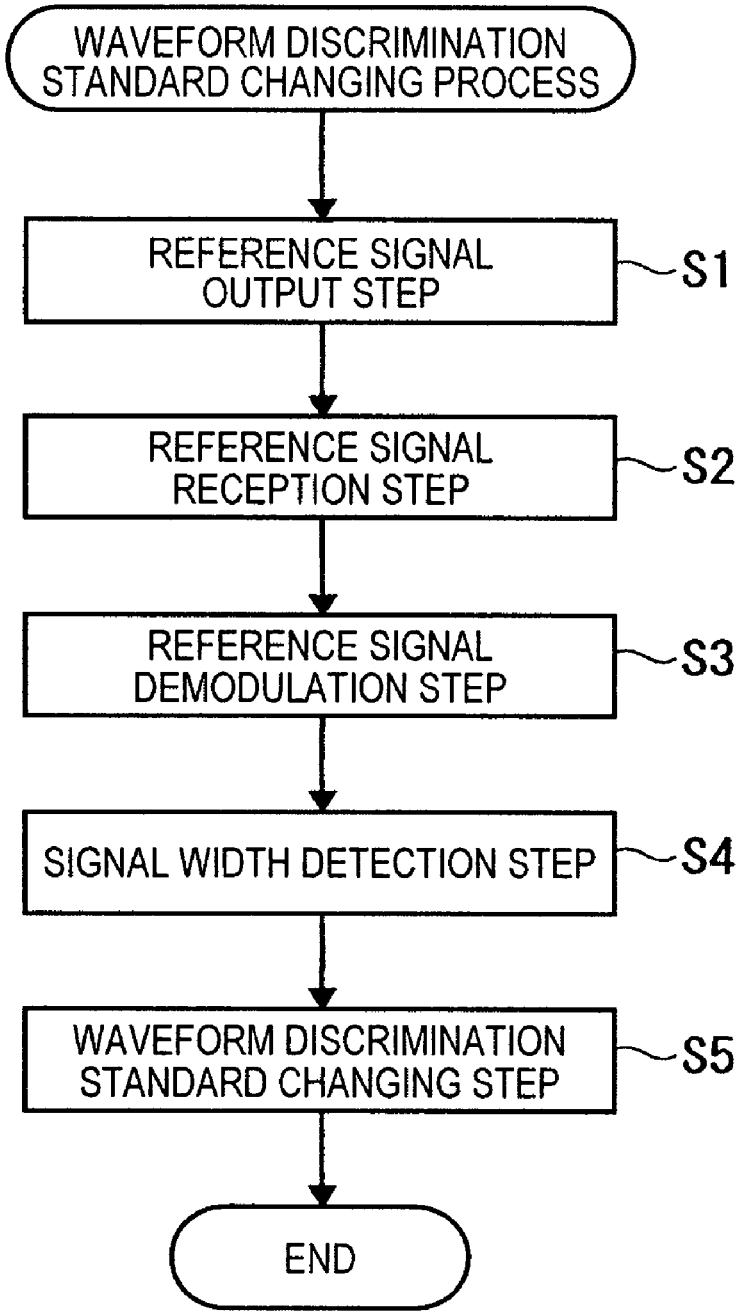
FIG. 4 is a flow chart of a method of changing the waveform discrimination standard of the radio-controlled timepiece according to a first embodiment of the invention.

As shown in FIG. 4 the method of changing the waveform discrimination standard of the radio-controlled timepiece 1 has a reference signal output step S1, a reference signal reception step S2, a reference signal demodulation step S3, a signal width detection step S4, and a waveform discrimination standard changing step S5.

When the waveform discrimination standard changing process is started, the reference signal output step S1 outputs a reference signal from an external device (not shown in the figure).

This aspect of the invention outputs a reference signal that repeats the 0 pulse of the German standard time signal.

In the reference signal reception step S2 the reception circuit 4 then receives the reference signal through the antenna 3 based on the control signal output from the microprocessor 2.

In the reference signal demodulation step S3 the demodulation circuit 5 demodulates the reference signal received by the reception circuit 4 to the time code signal. This signal resulting from demodulating the reference signal to the time code signal is referred to herein as the "demodulated reference signal."

In the signal width detection step S4 the signal width detector 212 measures the LOW signal width in the demodulated reference signal, and outputs the detected signal width to an external device (not shown in the figure).

Instead of using the signal width detector 212, this signal width detection step S4 could detect the LOW signal width in the demodulated reference signal output by the demodulation circuit 5 directly using an external pulse width measuring device.

In the waveform discrimination standard changing step S5 a worker or manufacturing device changes the waveform discrimination standard according to the LOW signal width in the demodulated reference signal measured by the signal width detector 212.

This embodiment of the invention describes using a method of changing the waveform discrimination standard by changing the jumper switch 6 connection by way of example.

As shown in FIG. 1, the external waveform discrimination standard setting unit 24 enables externally setting the waveform discrimination standard I to III by detecting whether the jumper switch 6 is set to K1, K2, or K3.

Figure 5:
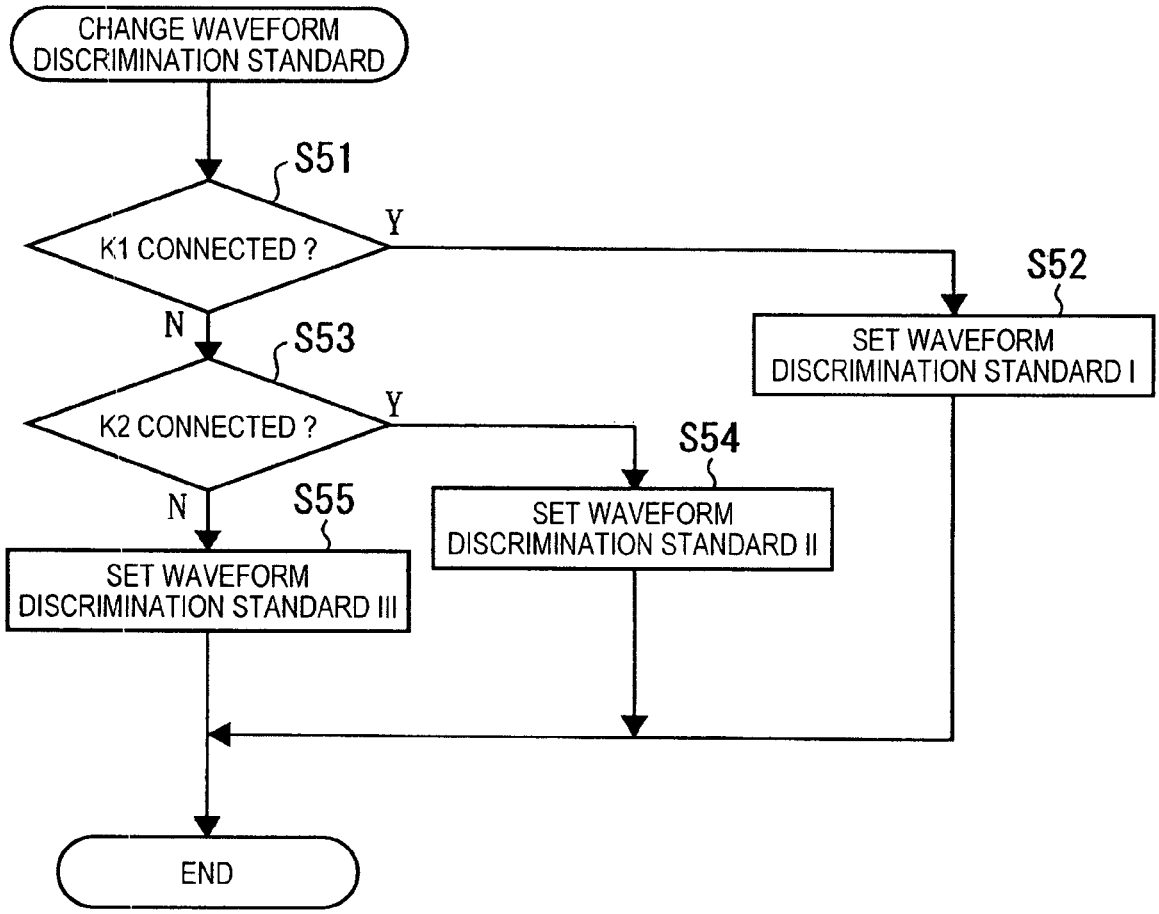
FIG. 5 is a flow chart of a method of externally setting the waveform discrimination standard by changing a jumper switch connection.

FIG. 5 is a flow chart of a method of externally setting the waveform discrimination standard by changing the connection of the jumper switch 6.

The external waveform discrimination standard setting unit 24 first determines if the jumper switch 6 is connected to pin K1 (S51) If the jumper switch 6 is connected to pin K1, the external waveform discrimination standard setting unit 24 selects waveform discrimination standard I (S52).

If the jumper switch 6 is not connected to K1, the external waveform discrimination standard setting unit 24 determines if the jumper switch 6 is connected to pin K2 (S53). If the jumper switch 6 is connected to pin K2, the external waveform discrimination standard setting unit 24 selects waveform discrimination standard II (S54).

If the jumper switch 6 is not connected to pin K2, the external waveform discrimination standard setting unit 24 sets waveform discrimination standard III (SS5).

The external waveform discrimination standard changing means in this embodiment of the invention includes the signal width detector 212, the waveform discrimination standard storage unit 213, the selector 214, and the external waveform discrimination standard setting unit 24.

When the waveform discrimination standard is externally set by the external waveform discrimination standard setting unit 24, the selector 214 selects the waveform discrimination standard set by the external waveform discrimination standard setting unit 24.

The method whereby the waveform discriminator 215 discriminates the waveform of the demodulated signal based on the waveform discrimination standard and outputs the corresponding codes when the radio-controlled timepiece 1 in this embodiment of the invention is used is described next.

The waveform discriminator 215 identifies the period in which the time code signal rises, or more specifically detects the sample number of the sample that goes from LOW to HIGH.

Figure 6:
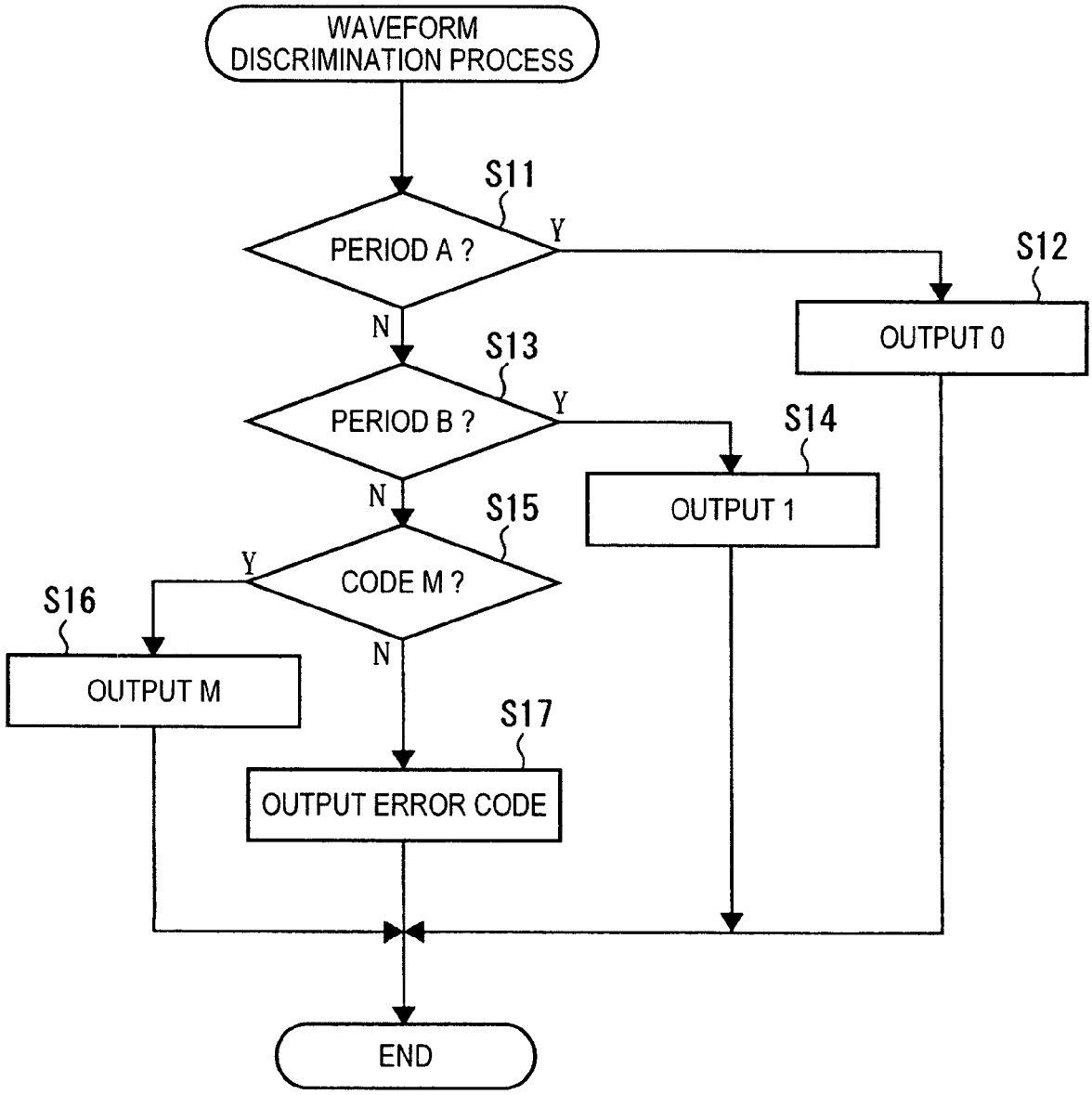
FIG. 6 is a flow chart of a method of discriminating the time code signal waveform and outputting the codes according to that waveform.

As shown in FIG. 6 the waveform discriminator 215 first determines if the sample number of the time code signal rise is in period A (S11). If the sample is in period A, the waveform discriminator 215 outputs a 0 (S12).

If the sample is not in period A, the waveform discriminator 215 determines if the sample number of the time code signal rise is in period B (S13). If the sample is in period B, the waveform discriminator 215 outputs a 1 (S14).

If the sample is not in period B, the waveform discriminator 215 determines if the time code signal rise is code M (S15).

More specifically, the discrimination period for the M code is samples 1 to 62, and the waveform discriminator 215 therefore determines if the sampled values are all HIGH throughout this period. If all sampled values are HIGH, the waveform discriminator 215 outputs the M code (S16).

If the samples are not all HIGH, and the code is therefore not a 1, 0, or M, the waveform discriminator 215 outputs the error code (S17).

If the signal width of the demodulated reference signal detected by the signal width detector 212 is 125 ms, for example, the signal rise is detected at sample 8. When the selector 214 then selects the waveform discrimination standard I, period A is samples 1 to 8 and the effects of the field strength and S/N ratio of the standard time signal cause the rise in the time code signal to change to sample 9, for example, the waveform discrimination process will not operate correctly.

In this case the jumper switch 6 is connected to pin K2 so that the selector 214 selects waveform discrimination standard II. This changes period A to samples 1 to 9 and the waveform discrimination process operates correctly even if affected by the field strength and S/N ratio of the standard time signal.

The benefits of a radio-controlled timepiece 1 according to this aspect of the invention are described below.

(1) The radio-controlled timepiece 1 has a waveform discrimination standard changing means. The selector 214 can therefore select the appropriate waveform discrimination standard from among plural waveform discrimination standards stored in the waveform discrimination standard storage unit 213. The waveform discriminator 215 can therefore discriminate the waveforms of the demodulated signal based on the waveform discrimination standard selected by the selector 214, and the waveform discrimination process can operate correctly even when affected by the field strength and S/N ratio of the standard time signal.

(2) Because the waveform discrimination process operates accurately, fewer error codes are output, the reception time is shortened, and power consumption is reduced.

(3) A reference signal repeating the 0 pulse wave is output in the reference signal output step, the reference signal is received in the reference signal reception step, and the reference signal demodulation step demodulates the reference signal and outputs a demodulated reference signal. As a result, the waveform discrimination standard can be changed in the factory using a precise reference signal with sufficient signal strength and no noise. Change in the signal width caused by variations during the manufacture of the radio-controlled timepiece 1 can therefore be accurately detected, and the waveform discrimination standard can be reliably set to account for detected deviations introduced in the manufacturing process.

Embodiment 2

A radio-controlled timepiece according to a second embodiment of the invention is described below.

Note that like parts in this and first embodiment are identified by like reference numerals, and further description thereof is omitted.

The radio-controlled timepiece 1 according to the first embodiment changes the waveform discrimination standard by causing the reception circuit 4 to receive a reference signal that repeats a specific code in the standard time signal and changes the connection of the jumper switch 6 according to the signal width of the demodulated reference signal measured by the signal width detector 212.

Figure 7:
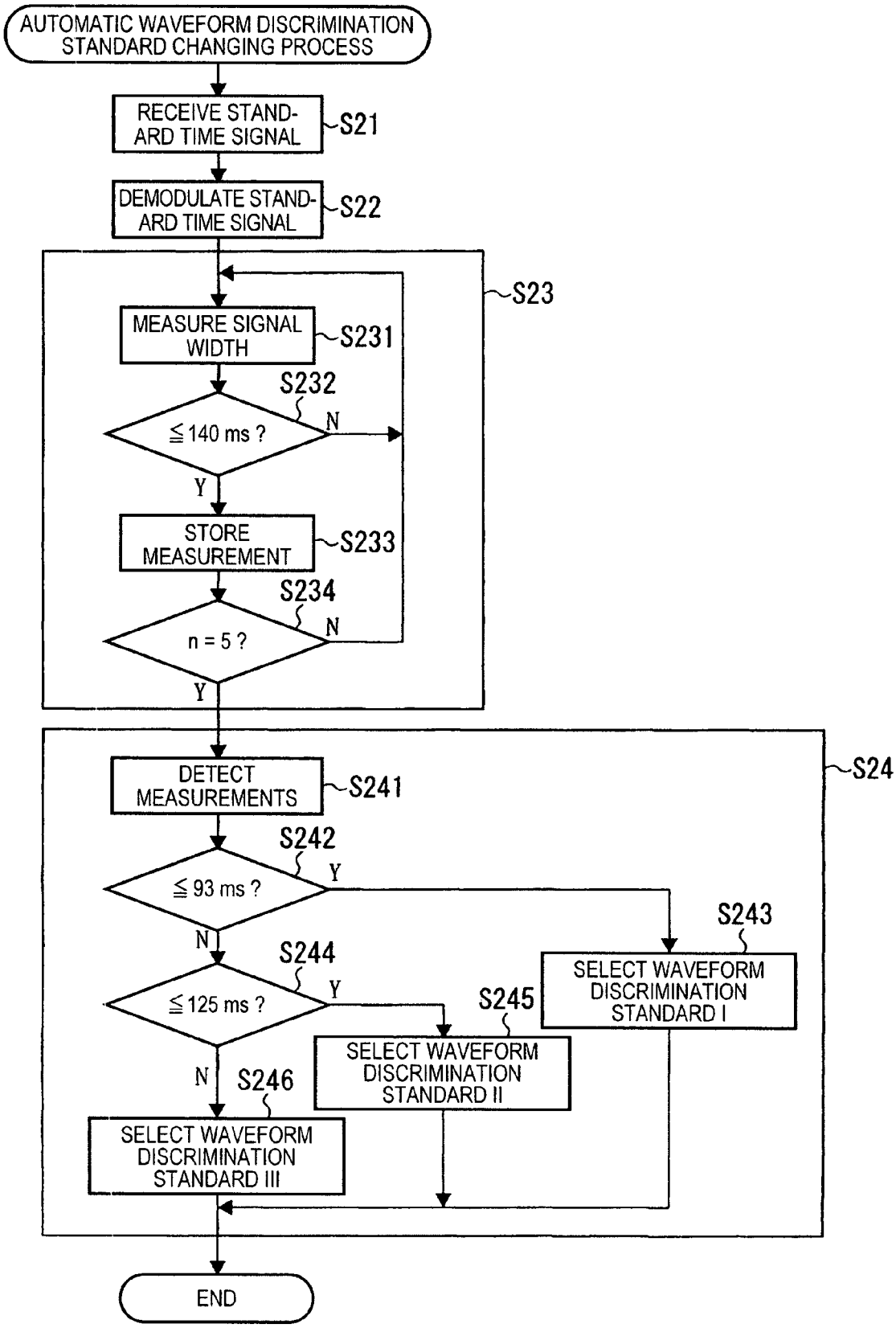
FIG. 7 is a flow chart of a method of changing the waveform discrimination standard of the radio-controlled timepiece according to a second embodiment of the invention.

The radio-controlled timepiece 1 according to this embodiment of the invention differs from the first embodiment in that the reception circuit 4 receives a long-wave standard time signal and the selector 214 automatically changes the waveform discrimination standard according to the signal width of the demodulated signal measured by the signal width detector 212 as shown in FIG. 7.

The waveform discrimination standard changing means in this embodiment of the invention includes the signal width detector 212, the waveform discrimination standard storage unit 213, and the selector 214.

The radio-controlled timepiece 1 according to this aspect of the invention starts an automatic waveform discrimination standard changing process at the preset time for receiving the standard time signal or when the user operates the radio-controlled timepiece 1 to unconditionally receive the standard time signal.

When this automatic waveform discrimination standard changing process starts the reception circuit 4 receives the standard time signal through the antenna 3 based on a control signal output from the microprocessor 2 in the standard time signal reception step S21.

The demodulation circuit 5 then demodulates the standard time signal received by the reception circuit 4 to the time code signal in the standard time signal demodulation step S22.

In the signal width detection step S23 the signal width detector 212 measures the LOW signal width of a 0 pulse at least once. In this embodiment of the invention the signal width detector 212 measures the LOW signal width five times.

The signal width detector 212 calculates the LOW signal width by counting the number of consecutive samples that are LOW in the demodulated signal.

The signal width detector 212 first measures the signal width of the demodulated signal (S231), and then determines if the result is less than or equal to 140 ms (S232). The German standard time signal includes 1, 0, and M codes, and one code is transmitted every second. If the measured LOW signal width is greater than 140 ms, the code is not a 0, and the signal width of the demodulated signal is measured in the next code (S231).

If the result is less than or equal to 140 ms, a 0 pulse is detected and the microprocessor 2 stores the result in memory (not shown in the figure) (S233).

The signal width detector 212 then determines if a 0 pulse is detected five times consecutively (S234). If not, the signal width of the demodulated signal for the next code is measured (S231).

If five 0s are detected, the selector 214 determines the most frequent result in the measured signal widths output by the signal width detector 212 in the waveform discrimination standard changing step S24. If the results are 109 ms, 125 ms, 109 ms, 93 ms, and 109 ms, for example, the 109 ms result is most frequent with a count of 3, and the selector 214 detects a signal width of 109 ms.

The selector 214 then detects if the detected result is less than or equal to 93 ms (S242). If the detected result is less than or equal to 93 ms, the selector 214 selects waveform discrimination standard I (S243).

If the result is greater than 93 ms, the selector 214 determines if the detected result is less than or equal to 125 ms (S244). If the detected result is less than or equal to 125 ms, the selector 214 selects waveform discrimination standard II (S245).

If the detected result is greater than 125 ms, the selector 214 selects waveform discrimination standard III (S246).

When the waveform discrimination standard is selected by the selector 214, the radio-controlled timepiece 1 ends the automatic waveform discrimination standard changing process, executes the reception using the selected waveform discrimination standard, and adjusts the time based on the received time information.

This embodiment of the invention affords the same benefits as benefits (1) and (2) of the first embodiment described above.

In addition, the waveform discrimination standard is changed automatically by causing the reception circuit 4 to receive the standard time signal when the radio-controlled timepiece is used. As a result, the waveform discrimination process returns accurate results even if the signal width of the code pulses varies due to the effects of the field strength and S/N ratio of the standard time signal, temperature fluctuations, or aging.

Furthermore, the signal width detector 212 measures the signal width of the demodulated signal five times, and the selector 214 changes the waveform discrimination standard based on the most frequently detected signal width. The effects of measurement error can thus be suppressed and the waveform discrimination standard can be changed based on precise measurements.

The production efficiency of the radio-controlled timepiece 1 is also improved because the waveform discrimination standard does not need to be adjusting when manufacturing the radio-controlled timepiece 1.

The invention is not limited to the foregoing embodiments and can modified and improved in many ways within the scope of the accompanying claims by one with ordinary skill in the related art.

For example, the invention is described herein using the German standard time signal DCF77 by way of example, but the invention can also be used with the standard time signals transmitted in other countries. More specifically, the invention can be used with any long-wave standard time signal containing time information, and can set the waveform discrimination standard according to the codes in the appropriate standard time signal.

The waveform of the 0 pulse is used as the reference signal in the foregoing embodiments, but the waveform of the 1 pulse can be used instead. More specifically, any signal that can be used as a reference for changing the waveform discrimination standard can be used.

The signal width detector 212 measures the LOW signal width of the demodulated reference signal in the foregoing embodiments, but the HIGH signal width can be measured instead. More specifically, it is only necessary to be able to change the waveform discrimination standard based on the measurement.

The falling edge in the time code signal, that is, the point where the time code signal goes from HIGH to LOW, is used as the reference position in the foregoing embodiments, but the invention is not so limited. More specifically, any place where the time code signal switches between HIGH and LOW due to the arrangement of the demodulation circuit, or the rising edge, that is, the point where the time code signal goes from LOW to HIGH, depending upon the type of standard time signal, can be used. More specifically, the reference position can be the starting point of any pulse waveform for a code that is transmitted once per second.

A plurality of discrimination periods in which the signal level of the waveform changes according to the code are defined in the waveform discrimination standard, but the invention is not so limited. The plural discrimination periods can be set to any part where the signal level changes according to the code, and other waveform discrimination standards can be used. More specifically, any standard that enables identifying the waveforms of the demodulated signal and outputting the correct corresponding code can be used.

The waveform discrimination standard storage unit 213 stores waveform discrimination standards I to III above, but a different number of waveform discrimination standards can be stored. More particularly, any number of waveform discrimination standards that enables changing the waveform discrimination standard can be stored.

Furthermore, discrimination periods are provided for the waveform discrimination standard as shown in FIG. 2, but other discrimination periods can be provided. More particularly, the discrimination periods are provided according to the specifics of the standard time signal transmitted in a particular country.

The waveform discrimination standard is changed by the selector 214 selecting one waveform discrimination standard from among the plural waveform discrimination standards stored in the waveform discrimination standard storage unit 213, but the waveform discrimination standard can be changed by calculating an equation based on the demodulated reference signal. More particularly, any method that enables changing the waveform discrimination standard according to a variable signal width can be used.

The radio-controlled timepiece 1 according to the first embodiment of the invention changes the waveform discrimination standard as a result of the reception circuit 4 receiving a reference signal that repeats a particular code in the standard time signal, and then changing the connection of the jumper switch 6 according to the signal width of the demodulated reference signal measured by the signal width detector 212, but the selector 214 can automatically change the waveform discrimination standard according the signal width of the demodulated reference signal measured by the signal width detector 212.

The radio-controlled timepiece 1 according to the second embodiment of the invention executes an automatic waveform discrimination standard changing process during the standard time signal reception process at preset time for receiving the standard time signal or the user forces the radio-controlled timepiece 1 to receive the standard time signal. The automatic waveform discrimination standard changing process can be executed every time the standard time signal is received, or every n-times the standard time signal is received.

The automatic waveform discrimination standard changing process can also be executed during the manufacturing process.

The signal width detector 212 measures the LOW signal width five times in the foregoing embodiments, but can measure the signal width only once or any number of times that enables changing the waveform discrimination standard automatically based on the measured signal width. The effect of measurement errors decreases as the measurement count increases, and precise measurements can therefore be achieved, but the number of measurements is preferably set according to the performance of the sampling circuit, for example, because more measurements take more time.

The signal width detector 212 measures the signal width of the time code signal at least once to get the desired measurements and the waveform discrimination standard is changed based on the most frequent result in the foregoing embodiment, but the waveform discrimination standard can be changed based on the average of the measurements, for example. More particularly, the waveform discrimination standard can be changed based on the measurements.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2006-229538, filed Aug. 25, 2006 is expressly incorporated by reference herein.

What is claimed is:

1. A radio-controlled timepiece comprising:

a reception means that receives a standard radio signal containing time information;

a demodulation means that demodulates the standard radio signal received by the reception means and outputs a demodulated signal;

a waveform identification means that identifies a waveform of a prescribed period of the demodulated signal based on a specific waveform identification standard which sets first and second periods of time in the prescribed period, the waveform identification means outputting a code which is a binary code 0 if a signal level of the waveform changes in the first period, a binary code 1 if the signal level of the waveform changes in the second period, or a code M;

a time information conversion means that converts the code output by the waveform identification means to time information; and a waveform identification standard changing means for changing the waveform identification standard by changing at least one of width and a starting position of each of the first and second periods, the waveform identification standard changing means including signal width measurement means for measuring signal width of the waveform of the demodulated signal, the waveform identification standard changing means setting the waveform identification standard based on the measurement by the signal width measurement means.

2. The radio-controlled timepiece described in claim 1, wherein the waveform identification standard changing means includes a waveform standard storage means for storing a plurality of waveform standards, and a selection means for selecting one waveform standard from among the plurality of waveform identification standards stored in the waveform identification standard storage means; and the waveform identification means identifies the demodulated signal waveforms based on the waveform identification standard selected by the selection means.

3. A method of changing a waveform identification standard for a radio-controlled timepiece, the radio-controlled timepiece having a reception means that receives a standard radio signal containing time information, a demodulation means that demodulates the standard radio signal received by the reception means and outputs a demodulated signal, a waveform identification means that identifies a waveform of the demodulated signal based on a specific waveform identification standard, and outputs a code corresponding to the waveform, a time information conversion means that converts the code output by the waveform identification means to time information, and a waveform identification standard changing means for changing the waveform identification standard, the method of changing the waveform identification standard comprising:

a reference signal output step of outputting a reference signal that repeats a specific code in the standard radio signal;

a reference signal reception step of receiving the reference signal;

a reference signal demodulation step of demodulating the reference signal and outputting a demodulated reference signal;

a signal width measurement step of measuring the signal width of the waveform in the demodulated reference signal and identifying whether or not the waveform satisfies the waveform identification standard to acquire resulting measurements; and a waveform identification standard changing step of changing the waveform identification standard according to the resulting measurements, the waveform identification standard changing step including signal width measurement step for measuring signal width of the waveform of the demodulated signal, the waveform identification standard changing step setting the waveform identification standard based on the measurement in the signal width measurement step.

4. The method of changing a waveform identification standard for a radio-controlled timepiece described in claim 3, wherein the signal width measurement step measures the signal width of the waveforms by sampling the demodulated reference signal or the demodulated signal to acquire the measurements, and the waveform identification standard changing step changes the waveform identification standard based on the most numerous value in the resulting measurements when a plurality of measurements are acquired.

5. A method of changing a waveform identification standard for a radio-controlled timepiece, the radio-controlled timepiece having a reception means that receives a standard radio signal containing time information, a demodulation means that demodulates the standard radio signal received by the reception means and outputs a demodulated signal, a waveform identification means that identifies a waveform of the demodulated signal based on a specific waveform identification standard, and outputs a code corresponding to the waveform, a time information conversion means that converts the code output by the waveform identification means to time information, and a waveform identification standard changing means for changing the waveform identification standard, the method of changing the waveform identification standard comprising:

a standard radio signal reception step of receiving the standard radio signal;

a standard radio signal demodulation step of demodulating the standard radio signal and outputting a demodulated signal;

a signal width measurement step of measuring the signal width of waveforms in the demodulated signal and identifying whether or not the waveform satisfies the waveform identification standard to acquire the resulting measurements; and a waveform identification standard changing step of setting the waveform identification standard according to the resulting measurements.

6. A method for controlling a radio-controlled timepiece, comprising:

receiving a standard radio signal containing time information;

demodulating the standard radio signal received by the reception means and outputting a demodulated signal;

identifying a waveform of a prescribed period of the demodulated signal based on a specific waveform identification standard which sets first and second periods of time in the prescribed period;

outputting a code which is a binary code 0 if a signal level of the waveform changes in the first period, a binary code 1 if the signal level of the waveform changes in the second period, or a code M;

conversing the code output to time information; and changing the waveform identification standard by changing at least one of width and a starting position of each of the first and second periods, the changing the waveform identification standard including measuring signal width of the waveform of the demodulated signal, the changing the waveform identification standard setting the waveform identification standard based on the measurement by the measuring the signal width of the waveform of the demodulated signal.

* * * * *